United States Patent [19]

Klimashko et al.

[11] 3,995,702

[45] Dec. 7, 1976

[54] REVERSIBLE PNEUMATIC PERCUSSIVE DEVICE FOR MAKING HOLES IN GROUND BY COMPACTION

[76] Inventors: Vladimir Vasilievich Klimashko, ulitsa Novogodnaya, 44, kv. 24; Khaim Berkovich Tkach, ulitsa Gogolya, 17, kv. 49; Vladimir Maximovich Terin, Mochischensky spusk, 68; Boris Nikolaevich Smolyanitsky, ulitsa Oleko Dundicha, 27, kv. 18; Boris Vasilievich Sudnishnikov, Krasny prospekt, 56, kv. 59; Veniamin Viktorovich Kamensky, ulitsa Derzhavina, 19, kv. 78; Alexandr Dmitrievich Kostylev, ulitsa Derzhavina, 19, kv. 44; Konstantin Stepanovich Gurkov, ulitsa Derzhavina, 19, kv. 13; Konstantin Konstantinovich Tupitsyn, Krasny prospekt, 51, korpus 3, kv. 25, all of Novosibirsk, U.S.S.R.

[22] Filed: July 8, 1975

[21] Appl. No.: 594,055

[52] U.S. Cl. ..... 173/91

[51] Int. Cl.[2] ..... E21B 1/00

[58] Field of Search ..... 173/91, 74, 78

[56] References Cited

UNITED STATES PATENTS

| | | | |
|---|---|---|---|
| 3,727,701 | 4/1973 | Sudnishnikov et al. | 173/91 |
| 3,756,328 | 9/1973 | Sudnishnikov et al. | 173/91 |
| 3,763,939 | 10/1973 | Sudnishnikov et al. | 173/91 |

*Primary Examiner*—James A. Leppink
*Attorney, Agent, or Firm*—Haseltine, Lake & Waters

[57] ABSTRACT

A device has a cylindrical housing with a pointed front portion, which accommodates a striker separating the inner space of the housing to form a front and rear active chambers. The striker is provided with an open space at the rear end face thereof which mounts an air distributing branch connection threaded in the housing to be axially displaceable therein for reversing the device motion and adapted to admit compressed air to the active chambers and discharge it to the atmosphere therefrom thus reciprocating the striker which applies impacts to the housing. The air distributing branch connection has pipes arranged coaxially and forming longitudinal passages, of which the central passage serves to admit compressed air to the active chambers, while the annular passage between the pipes is used to discharge spent air from the active chambers.

4 Claims, 4 Drawing Figures

REVERSIBLE PNEUMATIC PERCUSSIVE DEVICE FOR MAKING HOLES IN GROUND BY COMPACTION

The present invention relates to pneumatic percussive devices for making holes in ground, and more particularly it relates to reversible pneumatic percussive devices for making holes in ground by compaction of the latter.

The claimed device shall be used for trenchless laying of pipelines, electric cables, communication cables and the like.

In the art is known a pneumatic percussive device for making holes in ground by compaction of the latter. This device includes a cylindrical housing pointed in the front portion thereof, as in the direction of making holes, accommodating a striker adapted for axial movement therein and having lateral passages and a space open from the striker rear end. The striker divides the housing inner space into the front and rear active chambers and reciprocates under the action of compressed air delivered periodically to the active chambers to apply impacts at the housing. The device is provided with an air distributing branch connection with longitudinal and lateral passages for delivering air to and discharging it from the active chambers. The air distributing branch connection is threaded in the housing to be axially displaceable therein for reversing the device motion and is arranged in the striker space.

The longitudinal passage of the branch connection intended to admit compressed air to the active chambers is connected with a compressed air source by a hose secured rigidly to said branch connection. Inasmuch as said compressed air supply longitudinal passage is not coaxial with said branch connector, the hose secured thereto is not coaxial either.

The known device motion is reversed through the medium of displacement of the air distributing branch connection by rotating the hose which is rigidly secured to said connection. A non-coaxial connection of the hose with the air distributing branch connection impedes their rotation and reduces reversing reliability.

Another disadvantage of the known device consists in a complicated design of the air distributing branch connection stemming from the presence of two longitudinal passages therein which are to be separated hermetically from each other.

The object of the invention is to provide a reversible pneumatic percussive device for making holes in ground by compaction of the latter which will offer increased reliability of reversing.

Another object of the invention is to provide the afore-mentioned device with an air distributing branch connection of a simple design.

These and other objects of the invention are achieved by providing a reversible pneumatic percussive device for making holes in ground by compaction of the latter, comprising: a cylindrical housing pointed in the front portion thereof as in the direction of making said holes, accommodating a striker which divides the inner space of the housing into the front and rear active chambers, reciprocates under the action of compressed air delivered periodically to said active chambers to applys impacts to said housing of the device and has longitudinal passages and a space open from the rear end thereof, said space accommodating an air distributing branch connection threaded in the housing to be axially displaceable therein for reversing the device motion, said branch connection having a first longitudinal passage being in constant communication with a compressed air source and serving to periodically deliver air to the front active chamber through said space and lateral passages of the striker, a lateral passage communicating with the first longitudinal passage and used to periodically admit air to the rear active chamber, a second longitudinal passage and a second lateral passage communicated therewith which periodically connect the active chambers with the atmosphere for exhausting air. The longitudinal passages, according to the invention, of the air distributing branch connection are formed by two coaxial pipes, the first longitudinal passage being in constant communication with a compressed air source, is the inner pipe, while the second longitudinal passage constantly communicating with the atmosphere, is the annular space between the pipes.

Such a design provides for coaxial attachment of the hose to the branch connection thus increasing reliability of the device motion reversing.

It is preferable that the coaxial pipes of the air distributing branch connection be rigidly connected in the front portion of said connection with a partition closing hermetically the annular passage, and in the middle portion thereof, with a coupling arranged in the annular passage, having longitudinal through passages and passing a lateral passage which is communicated with said first longitudinal passage of the air distributing branch connection and serves to periodically supply compressed air to the rear active chamber.

Such a design simplifies the manufacture of the air distributing branch connection since it may be assembled of simple-shape parts.

It is preferable that the coaxial pipes of the air distributing branch connection be connected in the rear portion thereof by a partition with passages adapted to communicate the annular exhaust passage of the air distributing branch connection with the atmosphere.

This construction provides for increasing the strength and lateral rigidity of the air distributing branch connection, thus increasing the operational reliability of the device for making holes in ground.

It is also preferable that the coaxial pipes of the air distributing branch connection are coupled in the rear portion thereof with a nut screwed on the outer pipe, adapted to attach the hose to the inner pipe and having passages for connecting the annular passage of the air distributing branch connection with the atmosphere.

Such a design provides, by using one part, i.e. a nut, for attaching the hose to the air distributing branch connection for forming an additional partition at the rear portion of said connection, limiting axial displacement of the branch connection and increasing the section area of the exhaust passage.

Thus, the present invention provides a reversible pneumatic percussive device for making holes in ground by compaction of the latter, which offers increased reliability of the device reversing and simplified manufacturing processes.

The invention is explained hereinbelow by way of examples of its embodiment with reference to the accompanying drawings, wherein.

Figure 1:
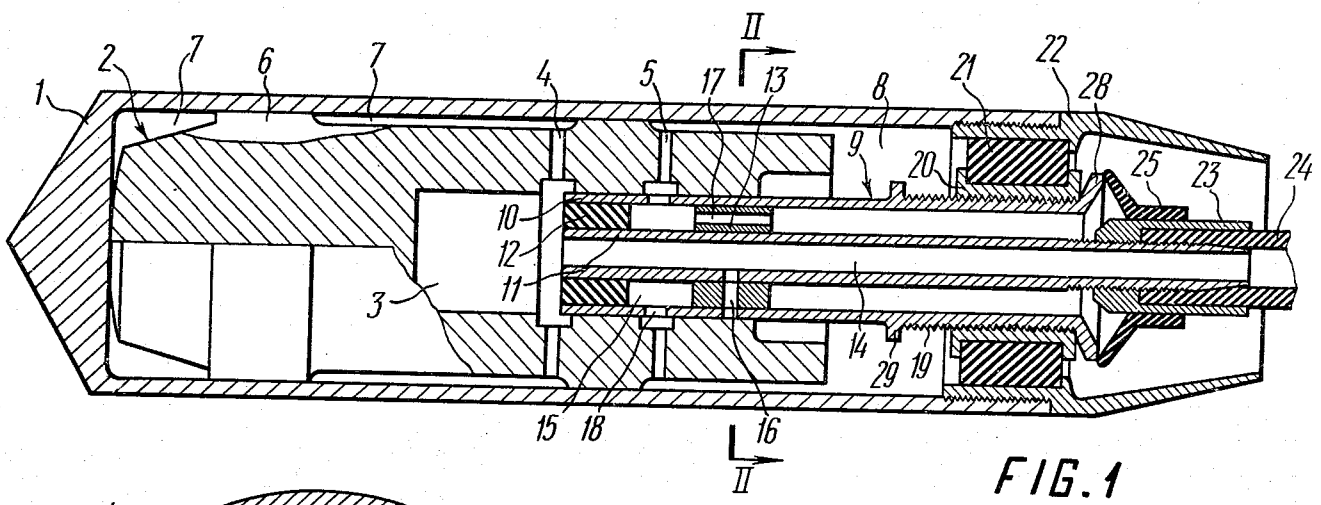
FIG. 1 is a longitudinal section of a reversing pneumatic percussive device for making holes in ground by compaction, according to the invention.
Figure 2:
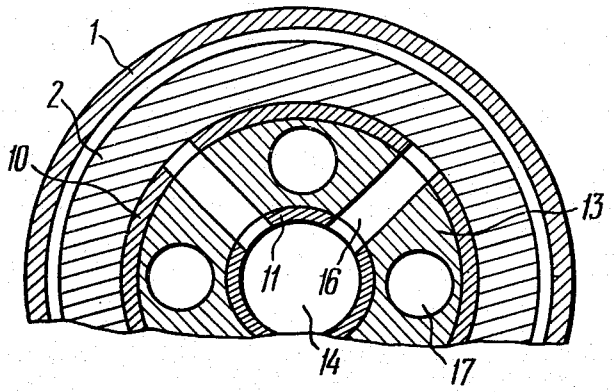
FIG. 2 is section II—II of FIG. 1.

As shown in FIGS. 1 and 2, the cylindrical housing 1 pointed front portion, as in the direction of making a hole, houses a striker 2 with a space 3 open from the rear end and radial 4,5 and longitudinal 6 passages.

The striker divides the inner cavity of the housing 1 into the front 7 and rear 8 active chambers which are alternately fed with compressed air to reciprocate the striker applying impacts to the housing.

The rear portion of the housing 1 mounts an air distributing branch connection 9 whose front portion enters the space 3 of the striker so that the striker 2 is enabled to slide relative to the branch connection 9.

The air distributing branch connection 9 has an outer 10 and inner 11 coaxial pipes connected by a plug 12 in the front portion and by a coupling 13 in the middle portion thereof.

The assembled air distributing branch pipe 9 is provided with a through central axial passage 14 and an annular passage 15, as well as with through radial passages 16 and longitudinal passages 17 which pass through the coupling 13. Besides, radial passages 18 are made in the outer pipe 10 of the branch connection 9 serving to alternately admit air to and exhaust it from the active chambers to the atmosphere.

The air distributing branch connection 9 is mounted by its rear portion with a thread 19 in a nut 20 secured via a shock absorber 21 with a nut 22 screwed in the rear portion of the housing 1.

Attached to the inner pipe 11 of the branch connection 9 by a nut 23 is a hose 24 which supplies the device, according to the invention, with a compressed air source (not shown).

Arranged on the nut 23 is a flexible baffle 25 intended to protect the device against ingress of soil particles through the exhaust passages.

Whenever increasing the lateral rigidity of the air distributing branch connection is necessary, the rear portion of the latter near the nut 23 is provided with an additional partition 26 (FIG. 3) which interconnects rigidly pipes 10 and 11. In this case the annular longitudinal passage 15 is connected with the atmosphere by means of passages 27 in the partition 26.

To strengthen the air distributing branch connection, simplify the design thereof by reducing the number of its components, and to increase the passage 27 areas to improve the air exhaust conditions, the coaxial pipes 10 and 11 of the air distributing branch connection are interconnected by a nut 23a (FIG. 4) which is made in such a way that, in addition to attaching the hose 24 to the inner pipe 11, it serves simultaneously, as a partition coupling the coaxial pipes 10 and 11, a rear limiter 28 for restricting axial displacement of the air distributing branch connection and has passages 27 for connecting the annular passage 15 with the atmosphere. To effect this the nut 23a is made so that it is screwed onto the thread 19 of the outer pipe 10 of the air distributing branch connection.

The device operates in the following way.

When connecting the device to a compressed air source, the space 3 of the striker 2 is constantly subject to the air pressure. Air is supplied to the space 3 via the hose 24 and the central passage 14 of the air distributing branch connection 9.

With the parts being in the relative position shown in FIG. 1, when the striker 2 is in the foremost, as in the direction of making the holes, position and the rear limiter 28 arranged on the pipe 10 (FIGS. 1, 3) or on the nut 23a (FIG. 4) contacts the nut 20, compressed air from the space 3 gets through the passages 4, 6 to the front active chamber 7.

Figure 3:
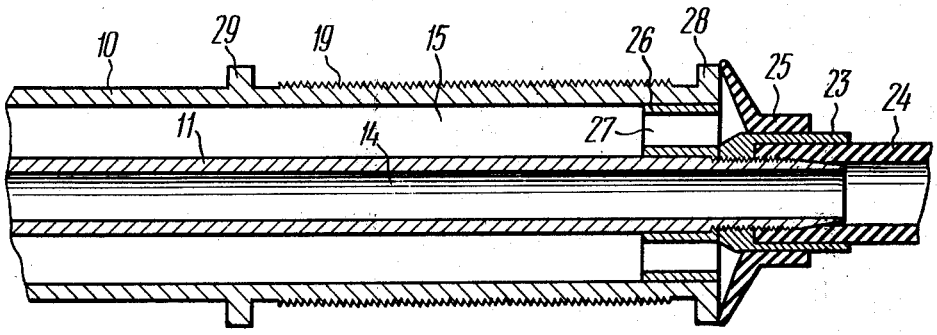
FIG. 3 is the rear portion of the air distributing branch connection which accommodates pipes coupled by an additional partition with passages for exhausting air, a longitudinal section.
Figure 4:
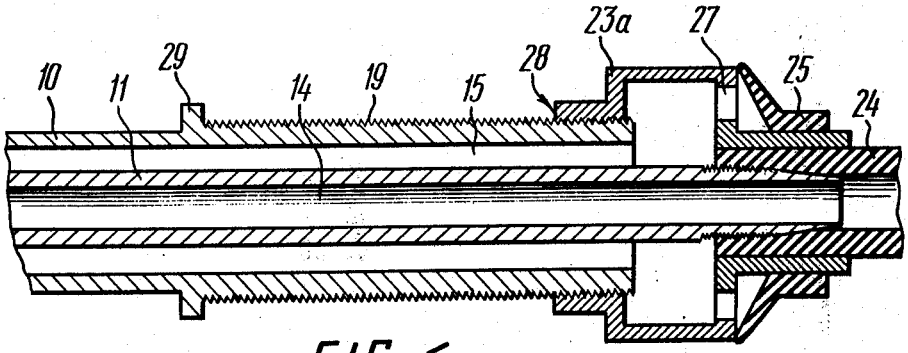
FIG. 4 is the rear portion of the air distributing branch connection wherein an additional partition coupling the coaxial pipes is made in the form of a nut attaching the hose to the air distributing branch connection, a longitudinal section.

The air pressure in the chamber 7 forces the striker 2 to effect a reverse stroke (towards the nut 22) while overcoming the resistance of the air pressure in the space 3 and of air compressed in the rear chamber 8. After the passages 4 of the striker 2 are overlapped by the pipe 10, the striker 2 moves with air expanding in the front active chamber 7. When the passages 4 of the striker and 18 of the air distributing branch connection get aligned, air from the front active chamber 7 escapes to the atmosphere via the passages 4, 18, 17 and 15 (FIG. 1) or the passages 4, 18, 17, 15 and 27 (FIGS. 3, 4). The flexible baffle 25 deflects under the action of the exhaust air pressure.

As the striker 2 keeps on moving towards the nut 22, the radial passages 5 of the striker and passages 16 of the air distributing branch connection get aligned. Compressed air is fed via the passages 14, 16, and 5 to the rear active chamber 8 and the striker 2 stops somewhat short of the end face of the nut 22.

The striker 2 effects a forward stroke under the action of compressed air in the rear chamber 8 and in the space 3. After disconnecting the passages 5 and 16 the air supply to the chamber 8 ceases and the striker progresses under the action of a constant pressure in the space 3 and expansion of air in the chamber 8.

At the end of the strike 2 forward stroke, its front end face applies an impact to the housing 1. Before the impact the rear active chamber 8 is connected to the atmosphere via the passages 5, 18, 17, 15 (27) that corresponds to the device part position shown in FIG. 1. Then the cycle repeats.

Under the action of the impacts the pointed portion of the housing 1 is introduced into the ground. The device displacement caused by a reactive force applied to the housing 1 during acceleration of the striker and directed oppositely to the utility motion is prevented by friction between the housing 1 and soil.

The reversing of the device to withdraw it from the well is effected by shifting the air distributing branch connection 9 to the rearmost position by unscrewing it from the nut 20 until the front limiter 29 on the branch connection 9 contacts the nut 20. Torque is transmitted from the well mouth via the hose 24 disconnected from the compressed air source beforehand.

Air is distributed in the reverse travel mode in the same way as in the forward travel mode.

However, displacement of the air distributing branch connection 9 to the rearmost position results in that compressed air from the space 3 via the passages 4, 6 gets into the front active chamber 7 somewhat in advance. The striker 2 is braked before striking the front portion of the housing 1 and starts moving in the reverse direction. During the reverse motion of the striker 2, the passages 4 of the latter, and passages 18 of the air distributing branch connection, as well as the passages 5 of the striker and passages 16 of the branch connection are aligned with a delay. Therefore, air is discharged from the chamber 7 and is admitted to the chamber 8 with a delay and the striker 2 is not braked before applying an impact to the end face of the nut 22 thus reversing the device to be withdrawn from the hole.

What is claimed is:

1. A reversible pneumatic percussive device for making holes in ground by compaction of the latter, comprising: a cylindrical housing pointed in the front portion thereof; a striker having lateral passages and a space open from the rear end face arranged in said housing and dividing the inner space of said housing into front and rear chambers and reciprocating under the action of compressed air supplied periodically to said chambers, said striker striking said housing in the course of said reciprocations; an air distributing branch connection for supplying compressed air to said chambers and threaded in said housing to be axially displaceable therein for reversing motion of said device and being arranged in the space of said striker, said branch having two coaxial pipes with an inner pipe forming a first longitudinal passage in constant communication with a compressed air source and serving to periodically supply air to the front chamber through the space and lateral passages of said striker, the annular space between said pipes being a second longitudinal passage in constant communication with the atmosphere; said air distributing branch connection having a lateral passage connected to the first longitudinal passage for periodically admitting air to said rear chamber, and a second lateral passage connected to said second longitudinal passage for periodically communicating via the lateral passages of said striker the second longitudinal passage with said chambers to exhaust air to the atmosphere therefrom.

2. A device according to claim 1, wherein the coaxial pipes of the air distributing branch connection are rigidly coupled in the front portion thereof by a partition which closes hermetically the annular passage of said branch connection, and in the middle portion, by a coupling arranged in the annular passage of said air distributing branch connection, provided with through longitudinal passages and passing a lateral passage communicated with said first longitudinal passage of the air distributing branch connection and serving to periodically supply compressed air to the rear active chamber;

3. A device according to claim 1, wherein the coaxial pipes of the air distributing branch connection are coupled in the rear portion thereof by a partition with passages which communicate the annular exhaust passage of said air distributing branch connection with the atmosphere.

4. A device according to claim 1, wherein said coaxial pipes of the air distributing branch connection are coupled in the rear portion thereof by a nut screwed onto the outer pipe, attaching the hose to said inner pipe and having passages which connect the annular passage of the air distributing branch connection with the atmosphere.

* * * * *